US008660826B2

(12) United States Patent
Leskelä et al.

(10) Patent No.: US 8,660,826 B2
(45) Date of Patent: Feb. 25, 2014

(54) METHOD FOR DETERMINING ASCENDING TIMES IN A DIVING COMPUTER, A DIVING COMPUTER AND A COMPUTER PROGRAM

(75) Inventors: Toni Lauri Leskelä, Vantaa (FI); Kari Markus Mäkiniemi, Espoo (FI); Erik Arvid Lindman, Espoo (FI)

(73) Assignee: Suunto Oy, Vantaa (FI)

( * ) Notice: Subject to any disclaimer, the term of this patent is extended or adjusted under 35 U.S.C. 154(b) by 635 days.

(21) Appl. No.: 12/732,894

(22) Filed: Mar. 26, 2010

(65) Prior Publication Data

US 2010/0250208 A1 Sep. 30, 2010

(30) Foreign Application Priority Data

Mar. 27, 2009 (FI) ..... 20095329

(51) Int. Cl.
*G06G 7/48* (2006.01)

(52) U.S. Cl.
USPC ..... 703/6

(58) Field of Classification Search
USPC ..... 703/6
See application file for complete search history.

(56) References Cited

U.S. PATENT DOCUMENTS

| | | | | |
|---|---|---|---|---|
| 5,363,298 | A | 11/1994 | Survanshi et al. | |
| 5,794,616 | A * | 8/1998 | Cochran et al. | 128/205.11 |
| 2005/0004711 | A1 | 1/2005 | Hirose | |

OTHER PUBLICATIONS

Delta P Technologies Ltd., "VR Computer Manual", pp. 2-120, Oct. 11, 2007.

Suunto Vytec DS, Kayttoohje (online), Suunto Oy, tammikuu 2006 (noudettu Feb. 24, 2012) Saatavissa Intemetista, 43 pages.

* cited by examiner

*Primary Examiner* — Hugh Jones
(74) *Attorney, Agent, or Firm* — Birch, Stewart, Kolasch & Birch, LLP

(57) ABSTRACT

A diving computer, a computer program, and a method for determining ascent time in a diving computer. Determining ascent time is accomplished by initially receiving initial data on the available gases and measuring the prevailing pressure and diving time. Then, based on information received in connection with the initial data, the gases are divided into at least primary (A) and secondary (B) gases, and an optimal dive plan is calculated based on the initial data of the primary gases (A), the prevailing pressure, and a surfacing model.

22 Claims, 2 Drawing Sheets

METHOD FOR DETERMINING ASCENDING TIMES IN A DIVING COMPUTER, A DIVING COMPUTER AND A COMPUTER PROGRAM

The present application claims priority under 35 U.S.C. §119 to FI Patent Application No. 20095329, filed Mar. 31, 2009.

FIELD OF THE INVENTION

The present invention relates to diving. The invention relates particularly to technical diving, in which compressed gases and diving computers are used.

BACKGROUND OF THE INVENTION

In scuba diving, it is typical to use a diving suit, compressed-gas tanks and a breathing regulator connected to them, and a diving computer. The diving computer shows the diver information on the prevailing environment, such as depth, pressure, and diving time, and on the gases available, and on the basis of these calculates the parameters that are important to performance, with the aid of a decompression model programmed into the device. In terms of diving, an important parameter is the temporal sufficiency of the available gases and the safe ascent time in decompression diving.

When diving to a sufficient depth, or if diving lasts for a sufficient length of time, the diver's surfacing speed must be limited, when the term decompression diving is used. In deep diving, amounts of nitrogen, helium, and other inert gases, which depend on the partial pressure of the gas inhaled, collect in the diver's blood circulation and tissues. The accumulated nitrogen causes problems when the diver rises towards the surface, when the ambient pressure decreases, leading to an increased risk of decompression sickness. The partial pressure of precisely nitrogen and helium is therefore monitored carefully when diving. Decompression sickness is a state in which nitrogen that has expanded in the blood or tissue due to a reduction in pressure forms bubbles, which, when they expand, can block blood vessels and damage tissue. To reduce the risk, the diver must observe at least one compulsory safety stop during ascent. The diving computer typically determines the depth for performing the safety stop or stops and the decompression time, by calculating them on the basis of the diving profile and decompression model, as well as of the prevailing conditions.

Commercial diving computers are previously known, which calculate a suitable decompression time based on the programmed gases. For example, VR Technology Ltd.'s VR3 diving computer prepares a dive plan based on the programmed gases, in such a way that the device calculates the time required for ascent by adapting the available gases to the prevailing conditions. The VR3 diving computer receives the data entered by the diver prior to diving. All the available gases, of which there can be ten, are entered in the device. Based on the content of these gases and on the depth, the computer calculates the necessary ascent time. In the calculation, the device seeks to optimize performance so that the gases fed to the diver are used at their optimal depth. However, the device's calculation algorithm allows for the effects of the duration of the necessary safety stops, and a possible failure to observe them, for instance on flying after diving.

The Suunto Vytec diving computer is also known, into which the diver can programme the available diving gases, prior to diving. During diving, the device's calculation algorithm suggests safety stops to avoid decompression sickness. The Vytec diving computer's algorithm on the other hand is based on calculating the necessary ascent time on the assumption that, during the ascent, the diver will not use other gases than the gas selected at each time. If the diver changes the selected gas and selects another gas programmed in the computer, the diving computer calculates the necessary ascent time by assuming that the selected gas will be used to ascend to the surface. In addition, only the diving gases carried by the diver are configured into the Vytec device.

In addition, a diving-gas mixing system is known from publication U.S. Pat. No. 5,794,616, which automatically uses the gas data for the gas in each of three tanks.

However, significant drawbacks are associated with the prior art. This is because, in diving computers according to the prior art, gases cannot be configured as primary and secondary gases, so that in problem situations during diving the diver may have very little time to react to the situation, because he must alter the mixture while subject to the stress arising from the problem. In known solutions, the gases of a diving partner or deco-station cannot be programmed as reserve, i.e. secondary gases, in case of possible problem situations. Thus, they cannot be exploited computationally in decompression, without them interfering with the calculation of the optimal dive plan and without the diving computer permitting their use, if their maximum operating depth permits. On the other hand, even reserve gases being carried cannot be programmed as described above, so that the dive cannot be optimized with the aid of the available decompression gases, in such a way that the dive plan's optimized length of time on the bottom would be altered for a possible safer surfacing.

The present invention is intended to resolve at least some of the problems of the prior art and to create an improved method for determining ascent time in a diving computer, as well as a diving computer and a computer program.

BRIEF SUMMARY OF THE INVENTION

In the method according to the invention for determining ascent time in a diving computer, initial data on the available gases are received, based on which the gases are classified as at least primary and secondary gases. During diving, the prevailing pressure and diving time are measured and an optimal dive plan is calculated on the basis of the initial data received on the primary gases, the prevailing pressure, and the surfacing model.

The diving computer according to the invention comprises a control unit, to which a user interface is connected for receiving and displaying diving-gas data, storage means for receiving, storing, and transmitting diving-gas data, and a pressure sensor for measuring the prevailing pressure and transmitting the measurement information to the control unit. The diving computer also comprises means for measuring the diving time, which means are arranged in the control unit. The control unit comprises means for classifying a diving gas as at least a primary or a secondary gas. Means are arranged in the control unit for creating a first and a second surfacing model, by which means the control unit is arranged to calculate the diver's surfacing time on the basis of the diving-gas data contained in the storage means, the pressure sensor's pressure information, and the diving-time measurement information. The control unit comprises, in addition, means for calculating the surfacing time on the basis of the classification of the primary gases formed using the first surfacing model. The control unit also comprises means for calculating the surfacing time on the basis of the classification of the secondary gases using the second surfacing model.

Considerable advantages are gained with the aid of the invention. With the aid of the invention, a diver can define two gas groups, of which the first, gas-group A, contains the gases that are planned to be used during ascent, and the second, gas-group B, contains the gases that will be available in a problem situation, for performing a safe ascent. The diver can also program the gases of his diving partner or the decompression station to be secondary gases, in which case these can be utilized in decompression without them interfering with the calculation of the planned diving-plan's ascent time and without the computer suggesting that these gases be used deeper than permitted by their maximum operation depth (MOD). If a diver is using doubled or tripled devices, he can define different settings for each setup and optimize the use of the decompression gases for his dive. In addition, in sudden problematic situations, it is particularly advantageous if the switch from primary to secondary gases is simple and quick, as when a diver meets a problem situation he is generally subject to considerable stress and urgency. Thus, the division and programming of the gases into primary and secondary gases before diving prepares the diver to be ready for, for example, possible device failures.

BRIEF DESCRIPTION OF THE SEVERAL VIEWS OF THE DRAWINGS

In the following, some embodiments of the invention are examined with reference to the accompanying drawings, in which.

DETAILED DESCRIPTION OF EXEMPLARY EMBODIMENTS

Figure 1:
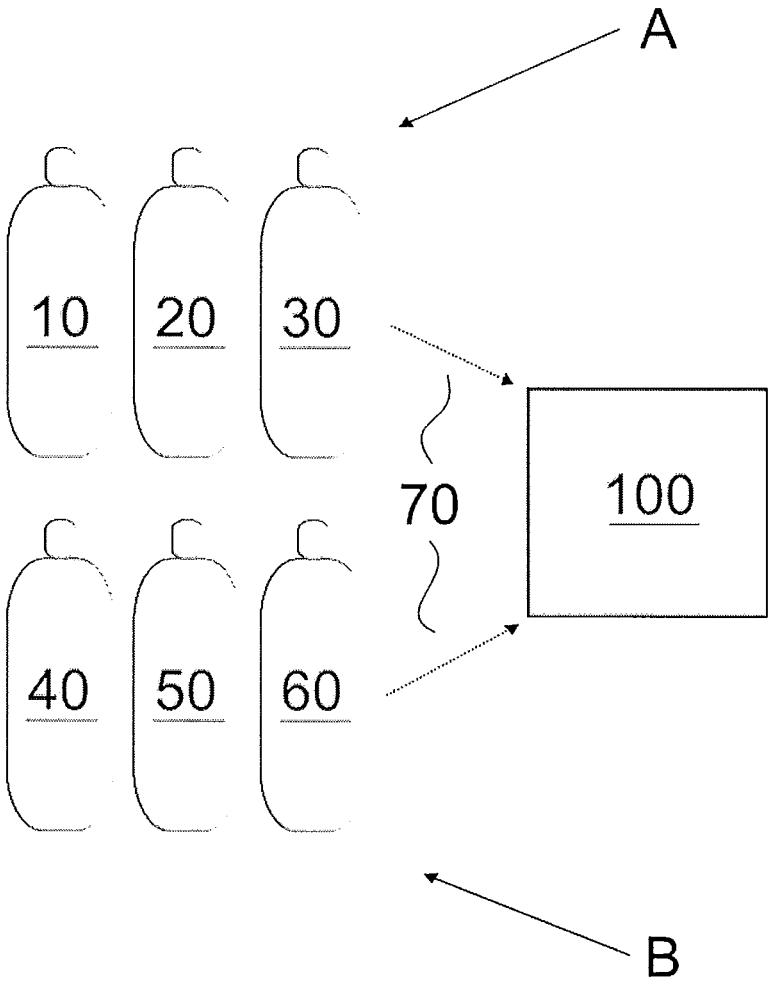
FIG. 1 shows schematically the division of the available gases into primary and secondary gases.

As can be seen from FIG. 1, at least two diving-gas groups, which in this connection will be referred to as primary gases A and secondary gases B, can be programmed into the diving computer 100. There can be more diving-gas groups than the two shown here. The gas tanks 10, 20, 30 carried by the diver are referred to as primary gases, with the necessary number, for example three, of such tanks being present, as shown in FIG. 1. In the example shown, the gas tanks 10 and 20 are filled with bottom gases, for example trimix and nitrox, while the gas tank 30 is filled with a decompression gas, which is breathed during ascent. In addition, the diving computer 100 can receive information on the state of the gas tanks 10, 20, 30 over, for example, a wired or a wireless data-transfer connection 70. Sensors connected to the valves of the diving-gas tanks, which can communicate with the diving computer, are known, for instance from Finnish patent application 20086136. However, it is usually the diver's task to monitor the pressure sensors connected to the gas tanks and to decide the length of the dive for which there will be enough gas.

Before diving, the primary gases A are programmed into the diving computer 100. During diving, the diving computer 100 measures the diving time and the prevailing pressure and calculates the remaining time for being on the bottom, or, in decompression diving, the amount of time required for surfacing, by utilizing surfacing models, on the basis of the diving time, the prevailing pressure, and the initial data of the activated primary gases A. In this connection, the term prevailing pressure refers to the ambient pressure, particularly the hydrostatic pressure, which varies according to diving depth. During programming, initial data on the composition of the primary gases A is entered in the diving computer 100. The diving computer 100 combines the initial data with the information transmitted by the sensors connected to the gas tanks 10, 20, 30, 40, 50, 60, or estimates the sufficiency of the gases on the basis of the dive duration and the depth profile. According to one embodiment, the diving computer 100 both combines the initial data with the information transmitted by the sensors connected to the gas tanks 10 . . . 60 and estimates the sufficiency of the gases based on the dive duration, in order to create the most accurate sufficiency information possible. The dive-plan calculation algorithms and their combination with the decompression models are known; as is the estimation of the sufficiency of the gases on the basis of their pressure information. In a normal situation, the diver carries out the dive according to the plan by breathing only the primary gases A. In that case, the diving computer calculates the shortest necessary ascent time and safety stops, in such a way that the gases are used sufficiently safely for decompression. In this connection, a dive plan of this kind is referred to as an optimal dive plan.

However, prior to diving, at least a second diving-gas group, i.e. the secondary diving gases B, is programmed into the diving computer 100. The secondary diving gases B are programmed into the diving computer 100 in case of possible problems, such as a device failure. For example, the gases of the diving partner, which the partner has allocated as reserve gases, or all the gases of the diving partner, can be entered in this gas group. Alternatively, or in addition, the gases contained in the decompression station, i.e. the decompression-gas base located close to the surface, can be configured as secondary gases B. The same data on the secondary gases B as on the primary gases A are programmed into the diving computer 100.

Alternatively, some of the gases carried by the diver can be programmed as secondary gases B. Such gases can be gases in extra tanks or gases calculated as surplus on the basis of the dive plan. This can be the case particularly in demanding technical diving, in which it is usual for critical gases to be doubled or even tripled in case of device failure.

At the start of a dive, the diving computer 100 automatically initiates the dive state, which is known. The dive state typically initiates on the basis of information provided by pressure and water contact. Starting from this moment, the diving computer 100 measures the duration of the dive, which is utilized when calculating the surfacing time, which is known. During the dive, the diving computer 100 displays information on the progress of the dive through a user interface, such as a display. The data displayed comprise the duration of the dive, the available gases, the depth, the temperature, the time, or some combination of these data. According to one embodiment, the diving computer 100 uses the user interface to show which gases 10 . . . 60 the calculation of the dive plan has been based on. As stated, when the dive proceeds normally, the diving computer calculates the optimal dive plan based on the primary gases A and takes no account whatever of the secondary gases B in the calculations. Should something go wrong, for example a device failure, the diver changes the gas group to the secondary gases B by selecting from them a gas that is suitable for use on the basis of its MOD and which is available. The diving computer 100 then calculates the ascent time, following the most cautious surfacing estimate, in which case the diving computer calculates the time required for ascent assuming that the primary gases are not available, but that the ascent will take place using solely the selected secondary gas. In this connection, such a dive plan is referred to as a securing dive plan. In practice, in a securing dive plan presence on the bottom is interrupted and a decompression model is used to calculate the length of the surfacing time required based on the pre-entered secondary gases B. The surfacing time of the securing dive plan will usually be quite long, because the preferred primary surfacing gases are not available, but instead reserve gases are used. Thus, the diving computer 100 calculates, from the reserve gas selected by the diver from the secondary gases B, a securing dive plan based on the surfacing model, by assuming that the selected reserve gas will be used for the entire ascent.

According to one embodiment, the diving apparatus, especially the gas tanks, is equipped with a fault sensor, which will detect a gas-feed problem and send an error signal concerning it to the diving computer 100 over the data-transfer link 70. The diving computer 100 then interprets the error signal as a command to switch to the secondary gases B.

According to one embodiment, if a gas B, which decompresses more effectively than the secondary gas being used, becomes usable in terms of its MOD as the diver ascends towards the surface, the diving computer 100 will permit the use of this gas. If the diver selects this gas, the diving computer 100 calculates a new securing dive plan based on the composition entered as its initial data. The priority will then be the safest possible surfacing of the diver, by reserving sufficient time and diving gas for decompression.

According to yet another embodiment, the diving computer 100 permits a primary gas A to be used, even though the diver has selected use of the secondary gases B.

This can take place in a situation, in which, for example, one primary gas A is not available due to a device failure, which has led to a change to the secondary gases B, which are used for surfacing according to the securing dive plan. However, the diving computer 100 will then allow use of the primary gases A, if permitted by their maximum operating depth MOD. Thus, the diver can change back to any primary gases A that are available, and which are suitable for the diving depth at that time. Each time a gas group or gas is changed, the diving computer 100 calculates a new surfacing time, which, according to one embodiment, is calculated as a securing dive plan, in which it is assumed that the gas in question will be used for the entire ascent.

A switch can also be made to the secondary gases B if the diver wishes to base his dive on a more pessimistic alternative.

According to one embodiment, the diving computer 100 receives information on the pressure of the gases 10 . . . 60, more specifically in their tanks, over a data-transfer link 70, on the basis of which the diving computer 100 estimates the sufficiency of the gases 10, . . . , 60 and calculates a securing dive plan by adapting to each other the measured tank pressure, the prevailing pressure, the sufficiency of the said gases 10 . . . 60, as well as the decompression calculation model. To demonstrate the advantageousness of this embodiment, assume by way of example a situation, in which the diving computer 100 ascertains during an ascent that the gases reserved for the ascent are insufficient for the coming decompression. It is then possible to either delay the switch from bottom gas to ascent gas, or more preferably to perform the ascent normally and, when the ascent gas empties, to switch back to a bottom gas of the same gas group, which is used as the decompression gas, if its MOD permits. The later alternative is naturally not optimal in terms of decompression, as the decompression properties of the bottom gases are usually very poor, which will lengthen the decompression time. The latter situation will be unavoidable, if the surface gas's MOD is small. A precondition for the embodiment is that, according to one embodiment, the diver programmes the size of the gas tanks of the gases 10 . . . 60 being used into the diving computer 100 along with the initial data, which information is exploited along with the measured pressure of each gas, to estimate computationally the amount of gas and thus the sufficiency of the gases. In other words, if the gas being used is insufficient for operation according to the dive plan, other gases of the same gas group A, B are exploited as computational reserve gases.

According to one embodiment, the diving computer 100 can estimate computationally the sufficiency of gas in the situation according to the previous embodiment, even without information on the size of the gas tank, by measuring the rate of change in pressure when using the gas and by taking into account the effect of the depth or the prevailing pressure on the consumption of breathing gas. If consumption causes the pressure in the gas tank to drop below a boundary value, the tank will be interpreted as being empty. In other words, if the gas available is insufficient for operation according to the dive plan, other gases of the same gas group A, B will be exploited as computational reserve gases. If, on the other hand, the diving computer 100 does not know the consumption history of some gas mixture, it will require tank-capacity data and the initial pressure in some device setups. In this case, the diving computer must be allowed to measure the tank pressure even if the gas is not yet being used. Such a situation can arise, for example, on the surface before the start of a dive, when the pressures can be measured by the computer in connection with the normal configuration run.

The following describes an example of a diving situation, in which the method according to the invention is used to determine the ascent time in a diving computer 100. As can be seen from Table 1, three trimix gases and oxygen have been programmed as the primary gas A. The first trimix gas (12/60) contains 12% oxygen, 60% helium, and 28% nitrogen, which gives a 98-meter MOD. The second trimix gas (21/35) contains 21% oxygen, 35% helium, and 44% nitrogen, giving a 63-meter MOD. The third trimix gas (40/10) contains 40% oxygen, 10% helium, and 50% nitrogen, giving a 29-meter MOD. As can further be seen from Table 1, in the situation according to the example, one trimix gas, one nitrox gas, and oxygen are programmed as the secondary gases B. The secondary-gas B trimix gas (32/20) contains 32% oxygen, 20% helium, and 48% nitrogen, giving a 38-meter MOD. The secondary-gas B nitrox gas (50) contains 50% oxygen and 50% nitrogen, giving a 21-meter MOD.

TABLE 1

The example's gas compositions.

| Gas group | Gas | O, % | N, % | He, % | MOD, m |
|---|---|---|---|---|---|
| A | trimix 12/60 | 12 | 28 | 60 | 98 |
| | trimix 21/35 | 21 | 44 | 35 | 63 |
| | trimix 40/10 | 40 | 50 | 10 | 29 |
| B | trimix 32/20 | 32 | 48 | 20 | 38 |
| | nitrox 50 | 50 | 50 | 0 | 21 |
| | oxygen | 100 | 0 | 0 | 6 |

In the example situation, the diver carries with him the trimix gases 12/60, 21/35, and 40/10, programmed as the primary gases A. He has programmed as secondary gases B his diving partner's trimix 32/20 and nitrox 50 gases as well as oxygen. The dive plan has been drawn up so that the bottom depth is 95 meters and the bottom time is 15 minutes. According to the plan, ascent will be made from the bottom depth of a depth of 38 meters, when about 70 minutes of the planned ascent will remain, to ensure safe surfacing. In the example situation, the diver performs the dive normally using the primary gases A, until at the said 38-meter depth a device fault occurs in the trimix 21/35 gas tank being used, which causes the diver to decide to switch to a reserve gas, in this case the secondary gas trimix 32/20. He then selects from the diving computer 100 the said secondary gas trimix 32/20 as the gas to be used, when the diving computer 100 calculates a new ascent time by assuming that only the trimix 32/20 gas is being used. Based on the prevailing pressure and the gas composition, the diving computer 100 uses a computational surfacing model to calculate that a safe ascent time is 123 minutes, which is longer than the original ascent time, due to the modest decompression properties of the reserve gas.

In the example case, the diver follows the diving computer's 100 ascent time to surfacing. According to one embodiment, the diver can alternatively switch to the primary trimix 40/10 according to the original dive plan, having reached a depth of 29 meters, which is the MOD of the gas in question. He then selects the primary gases A from the diving computer 100, of which the computer provides for use the trimix 40/10 gas, on the basis of its MOD. The diving computer 100 then calculates the safe ascent time on the basis of the gas and prevailing pressure, by assuming that during the final ascent the primary gases trimix 40/10 and oxygen will be available according to the plan. In the example case, the diving computer 100 would calculate the ascent time as 66 minutes according to the decompression model. A switch back to the primary gases A would then be advantageous, though surfacing would also succeed using the secondary gases B.

According to one embodiment, the diving computer 100 does not calculate an optimal dive plan, if the diver has once switched to using the secondary gases B. Thus, the diving computer 100 calculates a securing dive plan for the secondary gases B. The diving computer 100 does not, however, prevent use of the primary gases A, if their MOD is at least as great as the diving depth. If the diver selects a primary gas A for use, the diving computer 100 calculates a securing dive plan for the selected gas A by assuming that only the relevant selected gas will be used to the very end of surfacing.

According to a second preferred embodiment, the diving computer 100 does not prevent a return to the optimal dive plan, even though the diver may have switched to using the secondary gases B. Thus, if the diver has selected the secondary gases B, for example, by accident, he can revert to the first plan and a securing dive plan will no longer be calculated. Also, if the diver has switched to the secondary gases B, for example due to a device fault, and he switches back to the primary gases A, he must himself ensure from the user interface 130 of the diving computer 100 that the dive plan, more specifically the surface-time calculation, does not assume that the damaged gas is in use.

Figure 2:
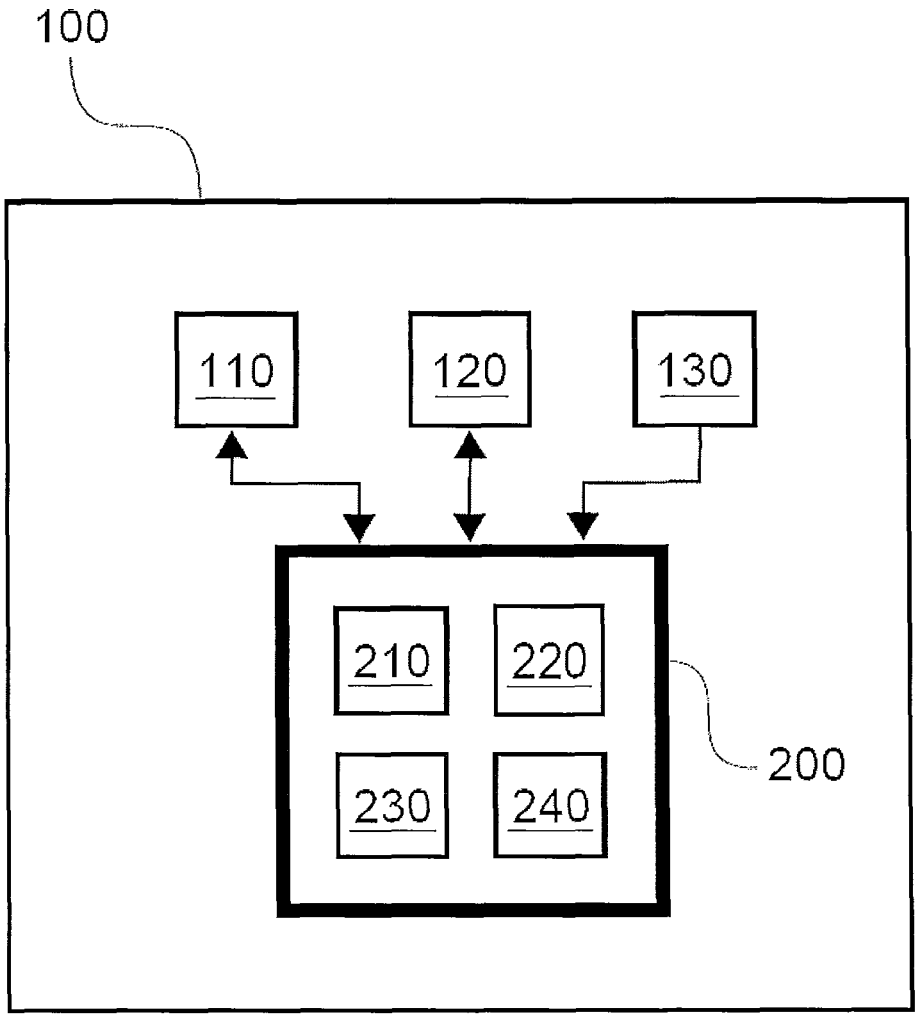
FIG. 2 shows a block diagram of the diving computer according to the invention.

As FIG. 2 shows, the diving computer 100 according to the invention comprises a user interface 110, through which the device communicates with the user. A typical user interface 110 comprises a display for showing information and a keypad for transmitting commands. According to one embodiment, the user interface 110 comprises a data-transfer port, through which the diving computer 100 is arranged to communicate with other devices, such as computers. Through the data-transfer port, data on the available diving gases, for example, can be entered in the diving computer, or through it data on previous dives, such as depth and duration data, can be downloaded. The diving computer 100 also comprises storage means 120, which are a conventional memory circuit or similar, used in portable devices. The diving computer 100 also comprises a pressure sensor 130 for measuring pressure and then calculating diving depth. The user interface 110, storage means 120, and pressure sensor 130 are known from commercial diving computers.

The diving computer 100 comprises a control unit 200, such as a microprocessor, which is connected to a user interface 110, storage means 120, and a pressure sensor 130 (FIG. 2). The user interface 110 and storage means 120 are connected to the control unit 200 in such a way that information can be transferred in both directions. Control unit 200, on the other hand, is only connected to receive measurement data from the pressure sensor 130. The control unit 200 itself comprises classification means 230, which are arranged to receive naming data on the entered gases and to classify them as primary and secondary gases A, B for operations by the control unit 200. The classification means 230 are preferably a programmed algorithm, which is run in the control unit 200, or they can be, for example, their own microcircuit, which is integrated in the control unit 200. According to one embodiment, the classification means 230 are a program, which is stored in the storage means 120. In addition, the control unit 200 comprises means for measuring the diving time 240, which means can be, for example, a clock circuit or, for example, software, which is stored in the storage means 120 and which the control unit runs.

The control unit 200 additionally comprises at least two means for creating surfacing models, the first of which being referred to in this connection as the first means for creating a surfacing model 210 and the second as the second means for creating a surfacing model 220. The said means can be, for example, microcircuits, which implement a program stored in the storage means 120, which contains the requisite surfacing-calculation algorithms, or they can be a circuit or circuits integrated in the control unit 200. In this connection, the means for creating surfacing models 210, 220 are referred to briefly as surfacing models. The surfacing models 210, 220 preferably comprise calculation algorithms or means that model the accumulation of the diving gases in the diver's tissues and the necessary decompression time at each prevailing pressure.

The first surfacing model 210 is arranged to create a calculation algorithm for calculating the shortest necessary ascent time and safety stops, in such a way that the primary gases A are used for a sufficiently safe decompression. In other words, the first surfacing model 210 is arranged to create a calculation algorithm for calculating an optimal dive plan for the primary gases A. It is then assumed in the calculation algorithm that the ascent will be performed in such a way that all of the primary gases A will be available to the diver. For its part, the second surfacing model 220 is arranged to create a calculation algorithm for calculating a securing dive plan for the secondary gases B. In other words, the second surfacing model 220 is arranged to create a calculation algorithm for calculating the ascent time, following the most cautious surfacing values possible. In the calculation algorithm of the second surfacing model 220, it is assumed that the ascent will be performed in its entirety using the relevant selected secondary gases B. Thus, with the aid of the second surfacing model 220, the control unit 200 is arranged to calculate the time required for ascent, assuming that the primary gases A are not available, but that instead the ascent will be performed using only the selected secondary gases B. Both surfacing models 210, 220 are arranged to allow for the MOD of each gas, which is itself known. Similarly, both surfacing models apply known tissue models, which take into account the effect of critical gases, particularly nitrogen and helium, on human tissue when subject to pressure variations. Due to the above, the control unit 200 is arranged to calculate, on the basis of the classification information of the classification means 230, the surfacing time, by using either the first or the second surfacing model 210, 220. According to the invention, the control unit 200 also comprises several calculation models, which the classification means 230 must then support.

According to one embodiment, the surfacing models are programs or a program, which are/is stored in the storage means 120.

In general, the diving computer 100 comprises control logic, which comprises the above features and which is thus arranged to instruct the diving computer 100 to implement the method according to the above description for determining ascent time in a diving computer. According to one embodiment, such control logic is a computer program, which is stored, for example, in storage means, and which is run in a control unit 200, which is a processor.

TABLE 2

Reference numbers.

| Number | Component |
|---|---|
| 10-60 | Gas |
| 70 | data transfer |
| 100 | diving computer |
| 110 | user interface |
| 120 | storage means |
| 130 | pressure sensor |
| 200 | control unit |
| 210 | means for creating a first surfacing model |
| 220 | means for creating a second surfacing model |
| 230 | means for classifying a diving gas |
| 240 | means for measuring time |

The invention claimed is:

1. A method for determining ascent time in a diving computer worn by a diver, and by means of the diving computer, the method comprising steps as follows:

prior to a dive:

receiving initial input data regarding gases which are available to the diver uring the dive, and receiving classification data for the gases as to whether each of the gases is a primary gas or a secondary gas, during the dive:

measuring ambient pressure, measuring overall diving time, receiving a gas selection input from the diver, and if a primary gas is selected, calculating a dive plan for the selected classification according to a first surfacing model, and if a secondary is selected, calculating another dive plan for the selected classification according to a second surfacing model different from the first surfacing model.

2. The method according to claim 1, further comprising:

receiving a command to switch from use of the primary gases to use of the secondary gases, and calculating a securing dive plan based on the input data of the secondary gases.

3. The method according to claim 1, further comprising:

deriving a diving depth from the measured pressure.

4. The method according to claim 1, further comprising;

permitting only a use of gases which have a maximum operating depth that is at least at a depth according to the ambient measured pressure.

5. The method according to claim 1, further comprising:

calculating the dive plan for only the selected secondary gases.

6. The method according to claim 1, further comprising:

permitting only a use of the secondary gases which have a maximum operating depth that is at least as great as a depth according to the ambient measured pressure.

7. The method according to claim 1, further comprising:

receiving a command for switching from the secondary gases back a use of the primary gases, and calculating an optimal dive plan based on the input data of the primary gases.

8. The method according to claim 1, further comprising:

receiving information on the pressure of the available gases over a data-transfer link.

9. The method according to claim 8, further comprising:

receiving information on a size of gas tanks of the gases in connection with the input data.

10. The method according to claim 9, further comprising:

calculating an amount of the available gases based on the pressure of the gases and the size of the gas tanks.

11. The method according to claim 8, further comprising:

calculating an amount of the available gases based on a rate of change in the pressure of the gases.

12. The method according to claim 10, further comprising:

calculating a surfacing time by adapting the dive plan to the calculated amount of the said gases.

13. The method according to claim 12, if the gas being used is insufficient for operation according to the dive plan, the method further comprising:

using other gases in a same gas group as computational reserve gases.

14. The method according to claim 1, further comprising:

showing the gases on which the dive plan has been calculated in an user interface of the diving computer.

15. The method according to claim 2, further comprising:

deriving the diving depth from the measured pressure.

16. The method according to claim 2, further comprising:

permitting only a use of gases which have a maximum operating depth that is at least at a depth according to the ambient measured pressure.

17. The method according to claim 3, further comprising:

permitting only a use of gases which have a maximum operating depth that is at least at a depth according to the ambient measured pressure.

18. A diving computer comprising:

a control unit configured to control the diving computer for calculating surfacing times according to a surfacing model, means for receiving, storing, and transmitting diving-gas data, the means connected to the control unit, and a pressure sensor, for measuring ambient pressure, the pressure sensor being arranged to transmit pressure-measurement information to the control unit, wherein the control unit comprises:

means for classifying gases as to whether each of the gases is a secondary gas or a primary gas, means for creating a first surfacing model, means for calculating a surfacing time for a primary gas or gases using classification data and the first surfacing model, means for creating a second surfacing model different from the first surfacing model, and means for calculating a surfacing time for a secondary gas or gases using the classification and the second surfacing model.

19. The diving computer according to claim 18, wherein the diving computer further comprises:

control logic, which is arranged to instruct the diving computer to implement a method comprising steps as follows:

prior to a dive:

receiving input data regarding gases which are available to the diver during the dive, and receiving classification data for the gases as to whether each of the gases is a primary gas or a secondary gas, during the dive:

measuring ambient pressure, measuring overall diving time, receiving a gas selection input from the diver, and if a primary gas is selected, calculating a dive plan for the selected classification according to a first surfacing model, and if a secondary is selected, calculating another dive plan for the selected classification according to a second surfacing model different from the first surfacing model.

20. The diving computer according to claim 18, wherein the driving computer comprises:

a user interface for receiving and displaying diving-gas data, and the user interface is connected to the control unit.

21. The diving computer according to claim 18, wherein the control unit comprises:

means for measuring diving time, and means for arranging control unit to calculate the diver's surfacing time based on the diving-gas data contained in the means for receiving, storing, and transmitting diving-gas data and pressure-measurement information transmitted by a pressure sensor.

22. A non-transitory, computer-readable-medium containing a program configured to instruct a diving computer to perform a method comprising steps as follows:

prior to a dive:

receiving input data regarding gases which are available to the diver during the dive, and receiving classification data for the gases as to whether each of the gases is a primary gas or a secondary gas, during the dive:

measuring ambient pressure, measuring overall diving time, receiving a gas selection input from the diver, and if a primary gas is selected, calculating a dive plan for the selected classification according to a first surfacing model, and if a secondary is selected, calculating another dive plan for the selected classification according to a second surfacing model different from the first surfacing model.

* * * * *